US012560403B2

(12) United States Patent
Wrecsics, Jr. et al.

(10) Patent No.: US 12,560,403 B2
(45) **Date of Patent: *Feb. 24, 2026**

(54) PROTECTOR FOR HAND OF FIREARM USER AND METHOD FOR USE THEREOF

(71) Applicants: Ernest L. Wrecsics, Jr., Canton, OH (US); Matthew D. Yingling, Canton, OH (US)

(72) Inventors: Ernest L. Wrecsics, Jr., Canton, OH (US); Matthew D. Yingling, Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/822,400

(22) Filed: Sep. 2, 2024

(65) Prior Publication Data

US 2024/0426567 A1 Dec. 26, 2024

Related U.S. Application Data

(60) Continuation of application No. 18/136,149, filed on Apr. 18, 2023, now Pat. No. 12,078,443, which is a continuation of application No. 17/979,596, filed on Nov. 2, 2022, now Pat. No. 11,635,273, which is a division of application No. 17/473,114, filed on Sep. 13, 2021, now abandoned.

(60) Provisional application No. 63/234,543, filed on Aug. 18, 2021.

(51) Int. Cl.
*F41A 35/02* (2006.01)
*F41C 33/08* (2006.01)

(52) U.S. Cl.
CPC ..... *F41A 35/02* (2013.01); *F41C 33/08* (2013.01)

(58) Field of Classification Search
CPC ..... F41A 35/02
See application file for complete search history.

(56) References Cited

U.S. PATENT DOCUMENTS 35,456 A * 6/1862 Leverich ..... F41A 35/02 42/96
3,574,965 A * 4/1971 Seiger ..... F41A 35/02 42/96
4,433,500 A * 2/1984 Kunevicius ..... F41A 35/02 42/74
4,488,313 A * 12/1984 Delaney ..... A41D 13/085 2/910
4,644,987 A * 2/1987 Kiang ..... F41C 23/18 42/74
4,754,498 A * 7/1988 Stinemates ..... F41A 35/02 42/106
4,805,338 A * 2/1989 Schublom ..... A41D 13/085 43/25
4,947,573 A 8/1990 Bischoff
5,177,893 A * 1/1993 Huntt ..... A01K 87/085 43/25

(Continued)

*Primary Examiner* — Derrick R Morgan

(57) ABSTRACT

A gun/hand muff for protecting portions of a gun user's hand, wrist, and/or forearm from the elements is provided. The gun/hand muff defines an interior cavity for ultimately receiving portions of a gun and portions of at least a gun user's hand and possibly portions of the gun user's wrist and forearm therein. The interior cavity is used to protect portions of the gun and the gun user's hand (and possibly portions of the gun user's wrist and forearm) from the elements, while simultaneously affording contact of the gun user's hand with the portions of the gun received in the interior cavity.

20 Claims, 10 Drawing Sheets

(56) References Cited

U.S. PATENT DOCUMENTS

| | | | | | |
|---|---|---|---|---|---|
| 5,461,728 | A * | 10/1995 | Staszak | A41D 13/081 | 224/222 |
| 5,509,143 | A | 4/1996 | Yates et al. | | |
| 5,678,249 | A * | 10/1997 | Smith | F41B 5/1473 | 2/161.1 |
| 5,678,344 | A * | 10/1997 | Jones | F41C 33/06 | 42/96 |
| 7,185,607 | B1 | 3/2007 | Pearson | | |
| D673,237 | S * | 12/2012 | Richey, Jr. | D22/108 | |
| 8,327,572 | B2 * | 12/2012 | Boggan | F41A 35/02 | 42/96 |
| 9,506,713 | B2 * | 11/2016 | Frazier | F41A 35/02 | |
| 10,006,738 | B2 * | 6/2018 | Stoppenhagen | F41B 5/1442 | |
| 10,010,121 | B2 * | 7/2018 | Kumprey | A41D 13/08 | |
| 11,659,876 | B2 | 5/2023 | Stoppenhagen | | |
| 2007/0062090 | A1 * | 3/2007 | Brindle | F41A 35/02 | 206/317 |
| 2011/0023347 | A1 | 2/2011 | Boggan et al. | | |
| 2014/0150321 | A1 * | 6/2014 | Fitzgerald | F41A 35/00 | 2/16 |
| 2017/0234643 | A1 * | 8/2017 | Stoppenhagen | F41B 5/148 | 124/88 |
| 2018/0202768 | A1 * | 7/2018 | Bridgman, Jr. | F41G 1/383 | |
| 2018/0347946 | A1 * | 12/2018 | Bridgman, Jr. | F41G 1/383 | |
| 2019/0107369 | A1 * | 4/2019 | Jones | F41G 1/383 | |
| 2020/0221797 | A1 * | 7/2020 | Stoppenhagen | F41C 27/00 | |

* cited by examiner

PROTECTOR FOR HAND OF FIREARM USER AND METHOD FOR USE THEREOF

This application is a continuation of U.S. application Ser. No. 18/136,149, filed Apr. 18, 2023; which is a continuation of U.S. application Ser. No. 17/979,596, filed Nov. 2, 2022; which is a divisional of U.S. application Ser. No. 17/473,114, filed Sep. 13, 2021; which claims the benefit of U.S. Provisional Application No. 63/234,543 filed Aug. 18, 2021; which are incorporated by reference herein.

FIELD

The present disclosure is generally related to a protector and a method for use thereof that affords protection from the elements for a gun user's hand when gripping and grasping a gun.

BACKGROUND

Rifle hunting, for example, oftentimes requires exposure of a hunter to adverse weather conditions. Such exposure to the elements can include exposure to cold, rainy, and snowy conditions. When exposed thereto, these elements can adversely affect a hunter gripping and grasping of portions of, for example, a hunting rifle. Therefore, there is a need for a protector and a method for use thereof that can protect at least a gun user's hand (and possibly portions of the gun user's wrist and forearm) from the elements, while simultaneously affording contact via direct or indirect contact of the gun user's hand with portions of a gun. As discussed below, a first embodiment of the protector is a gun/hand muff affording a gun user to grip and grasp the gun via direct contact with the gun user's hand, and a second embodiment of the protector is a gun/hand muff affording a gun user to grip and grasp the gun via indirect contact with the gun user's hand.

SUMMARY

The subject of the present disclosure relates to a protector and a method for use thereon. The protector and the method for use thereof affords a gun user to grip and grasp a gun, while simultaneously protecting the gun user's hand (and possibly portions of the gun user's wrist and forearm) from the elements.

In one aspect, the present disclosure provides a protector for at least portions of a hand of a gun user when holding a gun, the protector including a first portion including a proximal first end, an opposite distal second end, a first opening provided at the proximal first end, a second opening provided at the distal second end, and a first interior cavity portion extending from at least adjacent the proximal first end to at least adjacent the distal second end; a second portion including a proximal third end, an opposite distal fourth end, a third opening provided at the proximal third end, and a second interior cavity portion extending from at least adjacent the proximal third end to at least adjacent the distal fourth end; and an attachment area between the first portion and the second portion formed by attachment of the distal fourth end of the second portion to a portion of the first portion between the proximal first end and the distal second end; where the first interior cavity portion and the second interior cavity portion together define an interior cavity of the protector, and are open to one another at the attachment area of the first portion and the second portion; and where a first portion of a gun can be inserted through the first opening, through the first interior cavity portion, and out of the second opening, a second portion of the gun can be inserted through the first opening and into the first interior cavity portion to remain in the first interior cavity portion, and at least portions of the hand of the gun user can be inserted through the third opening, through the second interior cavity portion, into the first interior cavity to grip and grasp the second portion of the gun.

In another aspect the present disclosure provides a protector for at least portions of a hand of a gun user when holding a gun, the protector including a first portion including a proximal first end, an opposite distal second end, a first opening provided at the proximal first end, a second opening provided at the distal second end, and a first interior cavity portion extending from at least adjacent the proximal first end to at least adjacent the distal second end; a sheath including an interior portion extending between the first opening and the second opening inside portions of the first interior cavity portion; a second portion including a proximal third end, an opposite distal fourth end, a third opening provided at the proximal third end, and a second interior cavity portion extending from at least adjacent the proximal third end to at least adjacent the distal fourth end; and an attachment area between the first portion and the second portion formed by attachment of the distal fourth end of the second portion to a portion of the first portion between the proximal first end and the distal second end; where the first interior cavity portion of the first portion and the second interior cavity portion of the second portion together define an interior cavity of the protector, and are open to one another at the attachment area of the first portion and the second portion; and where a first portion of a gun can be inserted through the first opening, through the interior portion of the sheath, and out of the second opening, a second portion of the gun can be inserted through the first opening and into the interior portion of the sheath to remain in the interior portion of the sheath, and at least portions of the hand of the gun user can be inserted through the third opening, through the second interior cavity portion, into the first interior cavity to grip and grasp the second portion of the gun via contact with portions of the sheath.

In yet another aspect the present disclosure provides a method of using a protector for protecting at least portions of a hand of a gun user when holding the gun, the method including inserting a first portion of a gun through first opening of a first portion of the protector, through a first interior cavity portion of the first portion, and out of a second opening of the first portion; inserting a second portion of the gun through the first opening of the first portion and into the first interior cavity portion of the first portion;

inserting a hand of a gun user through a third opening of a second portion of the protector, through a second interior cavity portion of the second portion, and into the first interior cavity portion; and gripping and grasping the second portion of the gun with the hand of the gun user inside the second interior cavity portion of the second portion.

The details of one or more aspects of the disclosure are set forth in the accompanying drawings and the description below. Other features, objects, and advantages of the techniques described in this disclosure will be apparent from the description and drawings, and from the claims.

DETAILED DESCRIPTION

Figures 1, 2:
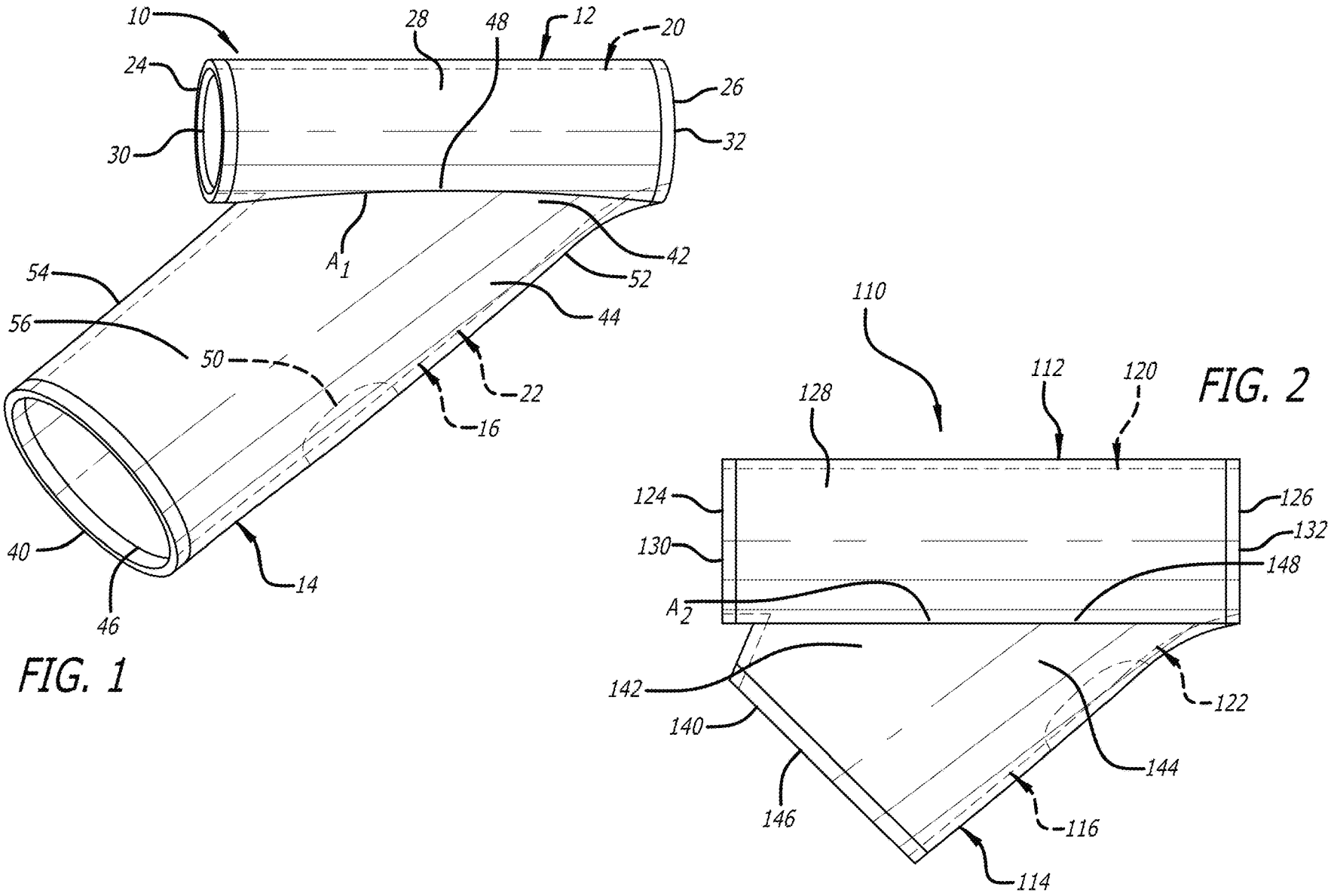
FIG. 1 is a side perspective view of a first version of a first embodiment of a protector in the form of a gun/hand muff.
FIG. 2 is a side elevational view of a second version of the first embodiment of the protector in the form of the gun/hand muff.

Generally, a first preferred embodiment of a protector in accordance with the present disclosure is a gun/hand muff that defines an interior cavity for ultimately receiving portions of a gun and portions of at least a gun user's hand and possibly portions of the gun user's wrist and forearm therein. The interior cavity is used to protect portions of the gun and the gun user's hand (and possibly portions of the gun user's wrist and forearm) from the elements, while simultaneously affording contact of the gun user's hand with the portions of the gun received in the interior cavity. The first preferred embodiment of the gun/hand muff affords the gun user to grip and grasp the gun via direct contact of the gun user's hand with the gun.

The first preferred embodiment of the gun/hand muff can include three (3) openings formed therein that provide access to the interior cavity. As discussed below, the three openings can communicate with the interior cavity, and afford insertion of portions of the gun and portions of at least a gun user's hand (and possibly portions of the gun user's wrist and forearm therein). The bigger the interior cavity, the more of the gun user's hand, wrist, and/or forearm can fit therein. Furthermore, the gun/hand muff can be sized so that portions of the gun user's clothing (such as long-sleeve shirt, jacket, and/or coat) can fit within or over portions of the gun/hand muff. For example, portions of a user's long-sleeve shirt can be received within the interior cavity of the gun/hand muff, and portions of a user's jacket or coat can be received over the gun/hand muff.

By inserting portions of the gun and at least the gun user's hand into the interior cavity, the gun user's hand can grip and grasp the portions of the gun inside the gun/hand muff within the interior cavity. For example, a first opening and a second opening of the three openings can have similar or different sizes, and can be substantially aligned with or offset from one another, and the arrangement of the first and second openings define an axis of insertion for insertion of portions of the gun including, but not limited to, a barrel, a forend, a handguard, and/or a rail. The first opening, the second opening, and the interior cavity of the gun/hand muff can accommodate portions of barrels, forends, handguards, and/or rails of, for example, automatic, semi-automatic, bolt action, break action, and pump action rifles and shotguns. To illustrate, portions of the gun including, for example, the barrel, the forend, the handguard, and/or the rail can be inserted through the first opening, through the interior cavity, and out of the second opening. And other portions of the gun including, for example, the barrel, the forend, the handguard, and/or the rail can remain within the interior cavity after insertion through the first opening and into the interior cavity.

A third opening of the three openings can be spaced apart from the first and second openings, and be located adjacent or removed from the axis of insertion. Portions of the gun user's left or right hand depending on the hand selected to manipulate a trigger of the gun (and possibly portions of the gun user's corresponding left or right wrist and corresponding left or right forearm) can be inserted through the third opening into the interior cavity. To facilitate insertion of the gun user's hand (and possibly portions of the gun user's wrist and forearm), the third opening can be larger than the first and second openings. Once inside the interior cavity, the gun user's left or right hand can physically grip and grasp the portions of the gun (for example, portions of the barrel, the forend, the handguard, and/or the rail) received in the interior cavity.

The first, second, and/or third openings can be expandable and contractable to afford passage of portions of the gun and at least portions of the gun user's hand therethrough and to afford cinching and/or sealing of the first, second, and third openings against portions of the gun and portions of the gun user's hand, wrist, and/or forearm. That is, perimeters of the first, second, and third openings can expand to allow passage therethrough, and thereafter, the perimeters of the first, second, and third openings can contract to cinching and/or seal against what has passed therethrough.

The expansion and contraction of the first, second, and/or third openings can be afforded by enclosures that facilitate such expansion and contraction. For example, portions of the gun/hand muff adjacent the first, second, and/or third openings can include elastic and/or drawstrings that afford expansion and contraction thereof. Furthermore, for example, the gun/hand muff can include an elastic cuff(s), a drawstring cuff(s), a button cuffs, snap button cuff(s), a Velcro® cuff(s), and/or similar enclosures adjacent the first, second, and/or third openings. Zippers also can be used to facilitate expansion and contraction of the of the first, second, and third openings. Expansion of the first and second openings can be great enough to afford passage of portions of the gun therethrough, and expansion of the third opening can be great enough to afford passage of portions of the gun user's hand, wrist, and/or forearm. Thereafter, contraction of the first and second openings around portions of the gun, and contraction of the third opening around portions of the gun user's hand, wrist, and/or forearm can serve in cinching and/or sealing the gun/hand muff against these portions. These cinches and/or seals serve in protecting portions of the gun and at least the gun user's hand from the elements by keeping the elements from entering the into the interior cavity.

Generally, a second preferred embodiment of a protector in accordance with the present disclosure is a gun/hand muff can include all of the features of the first embodiment of the gun/hand muff, except that the second preferred embodiment includes a sheath that extends between the first opening and the second opening through the interior cavity of the gun/hand muff. Rather than portions being inserted into, through, and out of the interior cavity of the gun/hand muff, portions of the gun are inserted into, through, and out of a sheath cavity of the sheath that extends between the first opening and the second opening. The second preferred embodiment of the gun/hand muff affords the gun user to grip and grasp the gun via indirect contact of the gun user's hand with the gun. To illustrate, portions of the gun including a barrel, a forend, a handguard, and/or a rail can be inserted through the first opening, through the sheath cavity, and out of the second opening. And other portions of the gun including the barrel, the forend, the handguard, and/or the rail can remain within the sheath cavity. Thus, the gun user can grip and grasp the gun via contact with the sheath with the gun user's left or right hand depending on the hard selected to manipulate a trigger of the gun, when portions of the gun (for example, portions of the barrel, the forend, the handguard, and/or the rail) are received in the sheath cavity and the gun user's left or right hand is inserted into the third opening of the second preferred embodiment.

As discussed below, the first and second preferred embodiments of the gun/hand muff can be constructed of one or more layers of materials having desirable properties. For example, the selection of materials for portions of the gun/hand muff can be based on waterproof/repellant properties, breathability properties, moisture-wicking properties, and/or insulative properties. Different portions and different layers of the gun/hand muff can be constructed of materials having these different properties.

For example, the first and second preferred embodiments of the gun/hand muff can be insulated against the elements for to protect against cold temperatures when the gun user's hand is gripping the gun. Such insulation can be used to retain heat from portions of the gun and/or the gun user's hand (and possibly portions of the gun user's wrist and forearm) inside the interior cavity. In addition to or in place of the insulation, the first and second preferred embodiments of the gun/hand muff can also include one or more pockets for receiving one or more hand-warmers. Such hand-warmers can, for example, be chemically and/or electrically activatable, and warmth generated by the hand-warmers can be used to warm the gun user's hand while gripping the gun. The one or more pockets can be provided on the inside or the outside of the interior cavity.

FIGS. 1-4 depict versions of the first preferred embodiment of the gun/hand muff generally indicated by the numerals 10, 110, 210, and 310 that are configured to receive portions of a firearm or gun G, and portions of the gun user's hand H, wrist W, and/or forearm F, as depicted in FIGS. 6-9. The first version of the first preferred embodiment of the gun/hand muff 10 includes a first portion 12, a second portion 14, and an interior cavity 16. The first portion 12 and the second portion 14 each include portions that can be formed as a sleeve, and these sleeves are attached to one another with the interior cavity 16 extending therethrough. For example, the first portion 12 and the second portion 14 can be formed unitarily with one another, or be formed separately and then integrated with one another. As discussed below, portions of the first portion 12 and the second portion 14 can each be formed from flexible, stretchable (for example, expandable/contractible), and/or malleable materials. The first portion 12 can include a first interior cavity portion 20 and the second portion 14 can include a second interior cavity portion 22, and the interior cavity portions 20 and 22 can communicate with one another and form portions of the interior cavity 16.

The first portion 12 can include a proximal end 24, a distal end 26, and a first body portion 28 extending between the proximal end 24 and the distal end 26. As depicted in FIG. 1, the first body portion 28 is formed as a sleeve through which the first interior cavity portion 20 extends. The first portion 12 can include a first opening 30 into the first interior cavity portion 20 (of the interior cavity 16) at the proximal end 24, and include a second opening 32 into the first interior cavity portion 20 (of the interior cavity 16) at the distal end 26. The first opening 30 and the second opening 32 can communicate with one another across the first interior cavity portion 20. Furthermore, the first opening 30 and the second opening 32 can have similar or different sizes, and be substantially aligned with or offset from one another.

The second portion 14 can include a proximal end 40, a distal end 42, and a second body portion 44 extending between the proximal end 40 and the distal end 42. As depicted in FIG. 1, the second body portion 44 is formed as a sleeve through which the second interior cavity portion 22 extends. The second portion 14 can include a third opening 46 into the second interior cavity portion 22 (of the interior cavity 16) at the proximal end 40. Furthermore, the first body portion 28 includes a bottom portion 48, and the distal end 42 of the second body portion 44 is attached at the bottom portion 48 to the first body portion 28 between the proximal end 24 and the distal end 26. As depicted in FIG. 1, for example, the first portion 12 and the second portion 14 are attached to one another at an attachment area $A_1$, so that a portion of the distal end 42 is positioned adjacent the proximal end 24, and another portion of the distal end 42 is positioned at and adjacent the distal end 26. At least portions of the bottom portion 48 and the distal end 42 are open to one another, such that the first interior cavity portion 20 and the second interior cavity portion 22 communicate with one another through such openings to form the interior cavity 16.

The first opening 30, the second opening 32, and/or third opening 46 are expandable and contractable, and the first body portion 28 and the second body portion 44 can be configured to facilitate such expansion and contraction. For example, portions of the first body portion 28 and the second body portion 44 adjacent the first opening 30, the second opening 32, and/or the third opening 46 can include elastic, drawstrings, and/or similar enclosures that afford expansion and contraction of the first, second, and third openings. Furthermore, the first body portion 28 and the second body portion 44 can include cuffs through which the first opening 30, the second opening 32, and/or third opening 46 are formed. The cuffs can have similar, larger, or smaller overall dimensions than adjacent portions of the first body portion 28 and the second body portion 44. Such cuffs, for example, can be elastic cuff(s), a drawstring cuff(s) (see, for example, FIG. 3), a button cuffs, snap button cuff(s), a Velcro® cuff(s), and/or similar enclosures adjacent the first, second, and/or third openings. These enclosures afford expansion and then contraction of the first opening 30, the second opening 32, and/or the third opening 46 around portions of the gun G and portions of the gun user's hand H, wrist W, and/or forearm F inserted therethrough. As such, portions of the first body portion 28 and the second portion 44 adjacent the first opening 30, the second opening 32, and/or the third opening 46, and/or the cuffs can serve in cinching and/or sealing the gun/hand muff against portions of the gun G and/or the gun user's hand H, wrist W, and/or forearm F.

The first portion 12 and/or second portion 14 can also include one or more pockets for holding one or more hand-warmers therein. For example, as depicted in FIG. 1, a pocket 50 is provided on the exterior of the second portion 14 along a frontward side 52 thereof. The pocket 50 and/or other pocket(s) can be provided on the exterior or in the interior of the second portion 14, and these pocket(s) can be positioned along the frontward side 52, a rearward side 54, and/or lateral sides 56 of the second portion 14.

As depicted in FIG. 1, the first portion 12 is sized smaller than the second portion 14. However, the gun/hand muff 10 and the other gun/hand muffs described herein are not so limited. For example, the first portion 12 and the second portion 14 can have similar sizes, or the second portion 14 can be sized smaller than the first portion 12. Given the size of the second portion 14 depicted in FIG. 1, the gun user's hand H and wrist W, and portions of gun user's forearm F can fit (FIG. 6) within the second interior cavity portion 22. The second portion 12 also can be sized so that portions of the gun user's clothing (such as long-sleeve shirt, jacket, and/or coat) can fit within or over portions of the gun/hand muff.

As also depicted in FIG. 1, the first body portion 28 of the first portion 12 and the second body portion 44 of the second portion 14 are pre-configured to have generally cylindrical shapes. However, the gun/muff 10 and the other gun/hand muffs described herein are not so limited. The first portion 12 and the second portion 14 can have other pre-configured shapes, such as tapered shapes between the proximal ends 24 and 40 and the distal ends 26 and 42, respectively, with one end having a larger size than the other end. For example, the proximal ends 24 and 40 can be larger than the distal ends 26 and 42, and vice versa. The first portion 12 and the second portion 14 can also have pre-configured shapes that have middle portions that have larger and/or smaller sizes that the proximal ends 24 and 40 and/or the distal ends 26 and 42, and the first portion 12 and the second portion 14 can be tapered toward or away from the larger or the smaller sizes of these middle portions.

Portions the first portion 12 and the second portion 14 (including the first body portion 28 and the second body portion 44, respectively) can be formed from flexible, stretchable (for example,, expandable/contractible), and/or malleable materials such as, for example, fabrics. As such, the first portion 12 and the second portion 14 can have shapes that are collapsible into smaller configurations. Furthermore, portions of the first portion 12 and/or the second portion 14 (including the first body portion 28 and/or the second body portion 44, respectively) and the sleeves formed thereby can be sized and/or be expanded/contracted in different directions to be form-fitting over portions of the gun G and/or the gun user's hand H, wrist W, and/or forearm F, when portions of the gun G are inserted through the first portion 12, and portions of the gun user's hand H, wrist W, and/or forearm F are inserted through the second portion 14. Portions of the first portion 12 and/or the second portion 14 (including first body portion 28 and/or the second body portion 44, respectively) and the sleeves formed thereby can alternatively be loose fitting over portions of the gun G and/or the gun user's hand H, wrist W, and/or forearm F.

Figure 6:
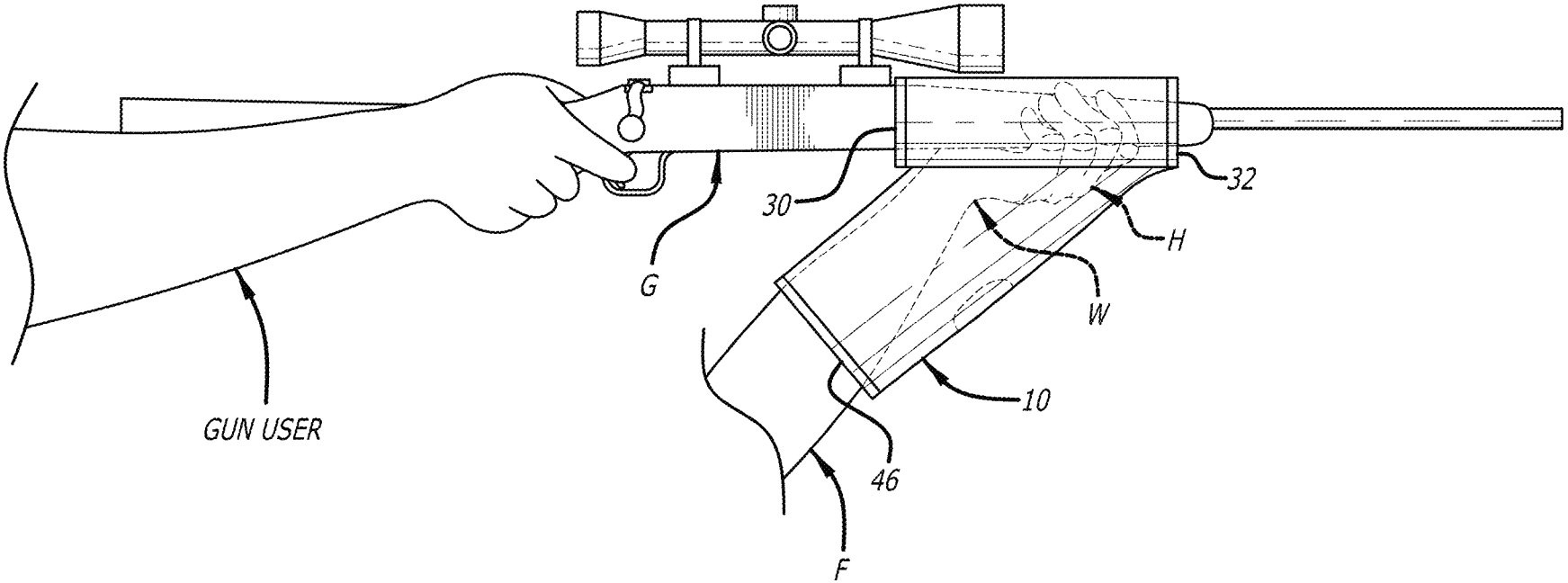
FIG. 6 is a side elevational view of the gun/hand muff of FIG. 1 positioned relative to a gun and at least the gun user's hand inserted through the gun/hand muff to grip and grasp the gun.
Figure 10:
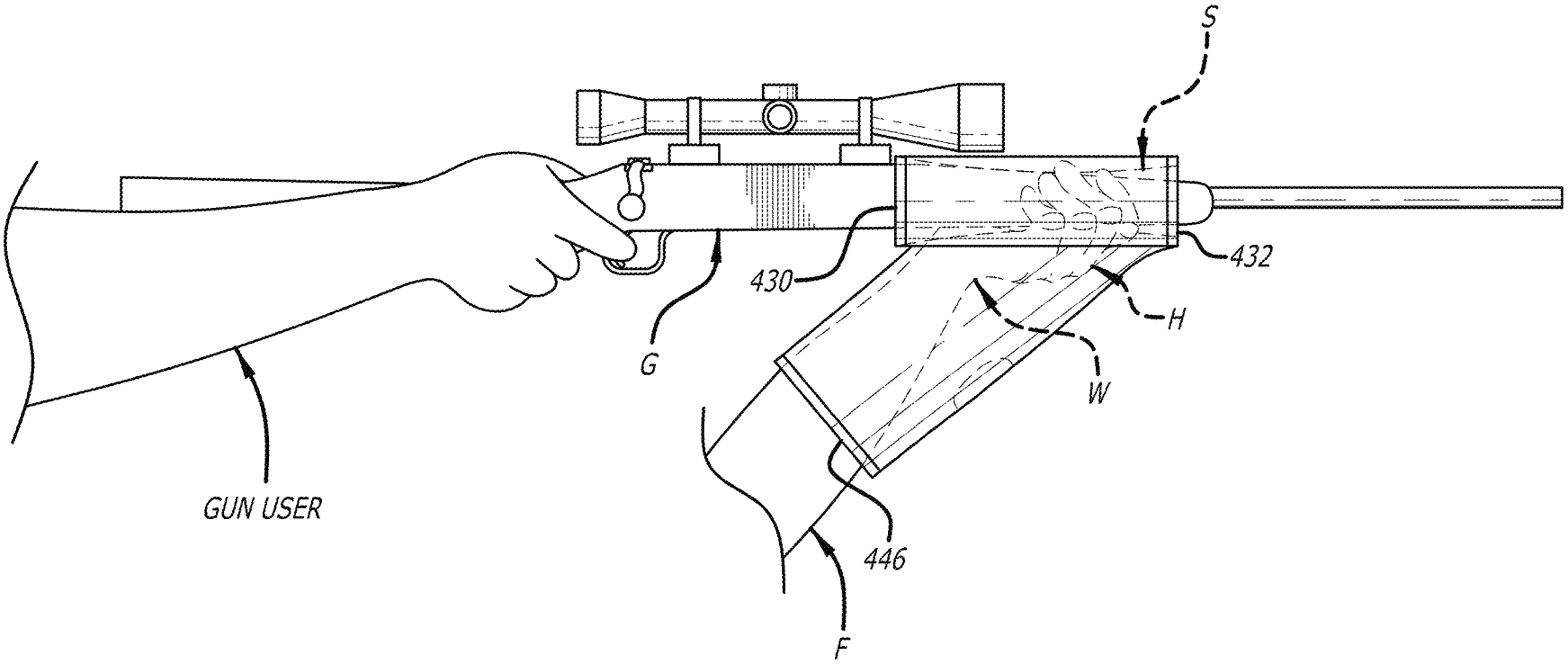
FIG. 10 is a side elevational view of the gun/hand muff of FIG. 5 positioned relative to the gun and at least the gun user's hand inserted through the gun/hand muff to grip and grasp the gun.
Figure 11:
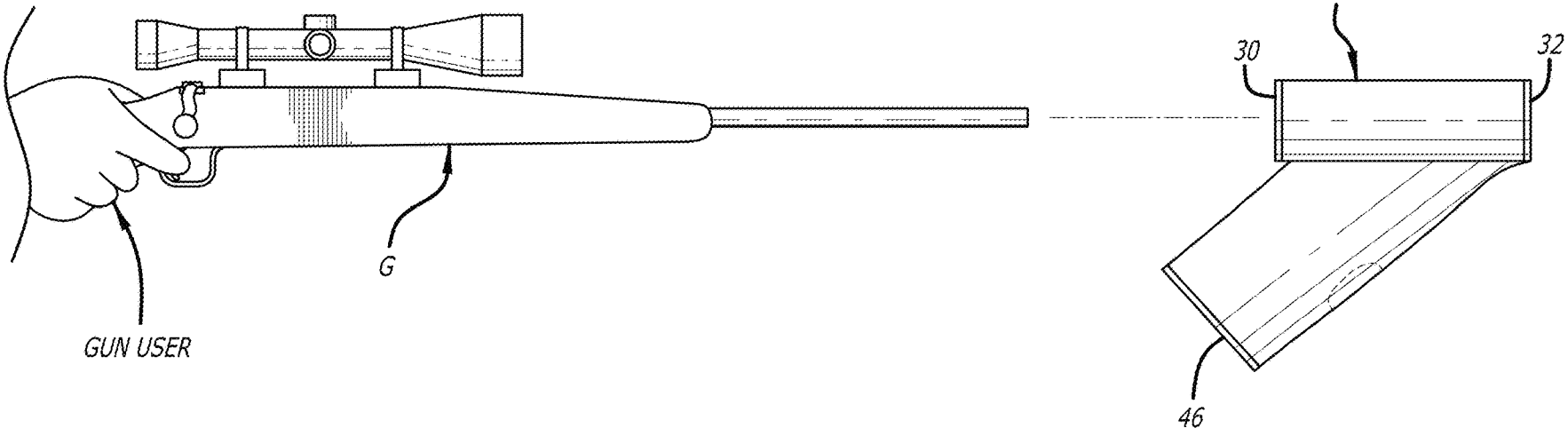
FIG. 11 is a side elevational view of the gun/hand muff of FIGS. 1 and 6 being positioned with respect to the gun.
Figure 12:
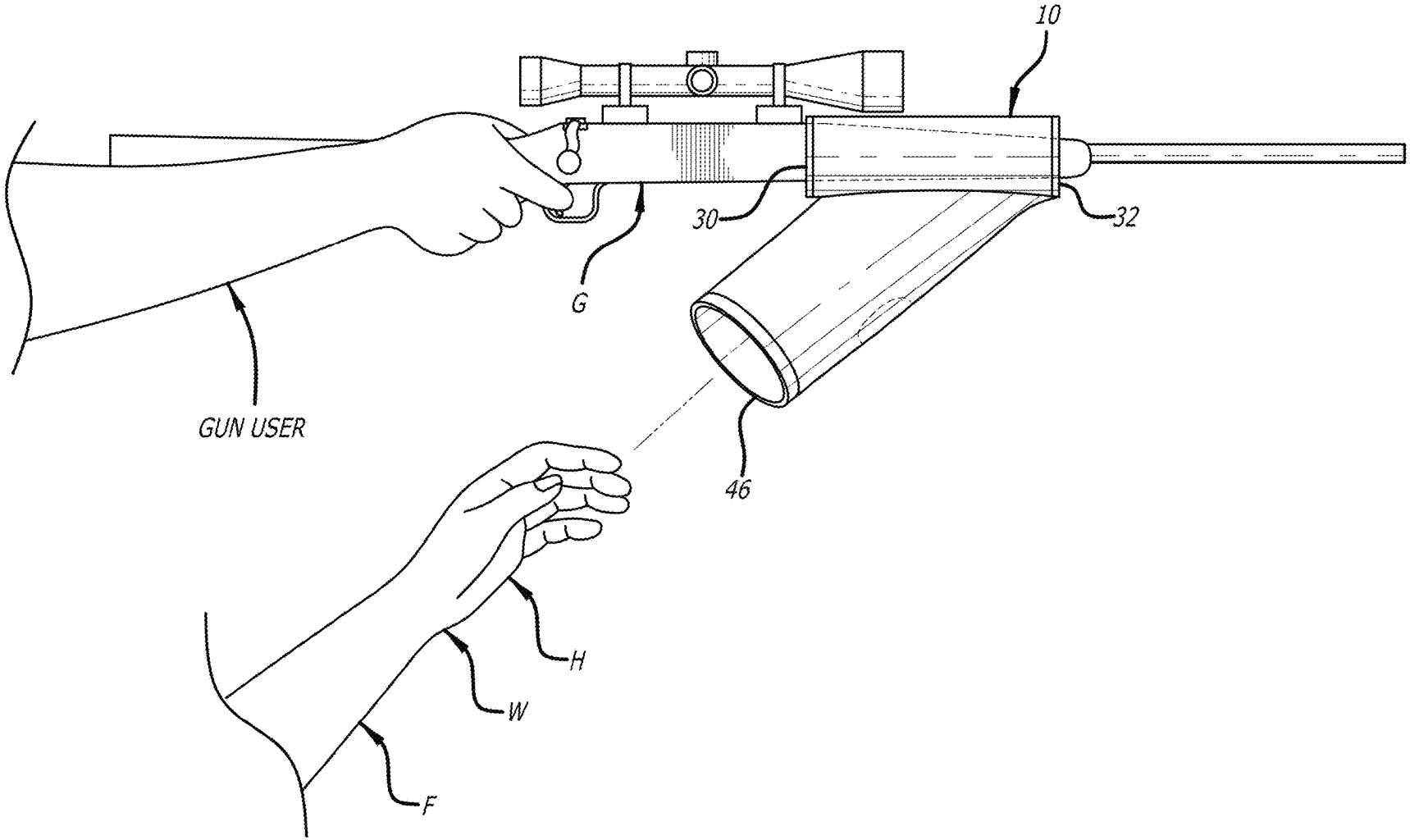
FIG. 12 is a side elevational view of the gun/hand muff of FIGS. 1 and 6 positioned with respect to the gun and the user's hand about to be inserted into the gun/hand muff.

When using the gun/hand muff 10, portions of the gun G (including, for example, the barrel, the forend, the handguard, and/or the rail) can, as depicted in FIGS. 6 and 10, be inserted through the first opening 30, through the first interior cavity portion 20, and out of the second opening 32. And other portions of the gun G (including, for example, the barrel, the forend, the handguard, and/or the rail) can, as depicted in FIG. 6, remain within the first interior cavity portion 20 after insertion through the first opening 30 and into the first interior cavity portion 20. Portions of the gun user's hand H (and possibly portions of the gun user's wrist W and forearm F) can, as depicted in FIG. 6, be inserted through the third opening 46, through the second interior cavity portion 22, and into the first interior cavity portion 20. The gun user's hand H can directly grip and grasp the portions of the gun G received in the first interior cavity portion 20. Portions of the gun G and portions of the gun user's hand H (and possibly portions of the gun user's wrist W and forearm F) can be inserted into the gun/hand muff 10 simultaneously, the portions of the gun G can be inserted first, or the portions of the gun user's hand H (and possibly portions of the gun user's wrist W and forearm F) can be inserted first. The process of insertion with respect to the gun/hand muff 10 can be completed for the portions of the gun G first, completed for portions of the gun user's hand H (and possibly portions of the gun user's wrist W and forearm F) first, or completed simultaneously.

The second version of the first preferred embodiment of the gun/hand muff 110 is depicted in FIG. 2, and similar numbering to that used for the gun/hand muff 10 is also used for the gun/hand muff 110. The gun/hand muff 110 includes a first portion 112, a second portion 114, and an interior cavity 116. The first portion 112 and the second portion 114 can each include portions that can be formed as a sleeve, and these sleeves are attached to one another with the interior cavity 116 extending therethrough. The first portion 112 and the second portion 114 can be formed unitarily with one another, or be formed separately and then integrated with one another. As discussed below, portions of the first portion 112 and the second portion 114 can each be formed from flexible, stretchable (for example, expandable/contractible), and/or malleable materials such as, for example, fabrics. As such, the first portion 112 and the second portion 114 can have shapes that are collapsible into smaller configurations. Furthermore, portions of the first portion 112 and the second portion 114 (and the sleeves formed thereby) can be sized and/or expanded/contracted in different directions to be form-fitting or can be loose fitting around portions of the gun G and portions of the gun user's hand H, wrist W, and/or forearm F, when portions of the gun G are inserted through the first portion 112, and portions of the gun user's hand H, wrist W, and/or forearm F are inserted through the second portion 114.

The first portion 112 includes a first interior cavity portion 120, and the second portion 114 includes a second interior cavity portion 122. The first portion 112 includes a proximal end 124, a distal end 126, a first body portion 128, a first opening 130, and a second opening 132 in similar arrangement to corresponding portions of the first portion 12 of the gun/hand muff 10. And the second portion 114 includes a proximal end 140, a distal end 142, a second body portion 144, and a third opening 146. Portions of the first portion 112 and/or the second portion 114 adjacent the first opening 130, the second opening 132, and/or the third opening 146 can have similar configurations to those of the first portion 12 and the second portion 14 adjacent the first opening 30, the second opening 32, and the third opening 46 to facilitate expansion and contraction with or without use of the above-discussed cuffs with these openings. The cuffs can have similar, larger, or smaller overall dimensions than adjacent portions of the first body portion 128 and the second body portion 144. Portions of the first body portion 128 and the second portion 144 adjacent the first opening 130, the second opening 132, and/or the third opening 146, and/or the cuffs can serve in cinching and/or sealing the gun/hand muff 110 against portions of the gun G and/or the gun user's hand H, wrist W, and/or forearm F.

The first body portion 128 and the second body portion 144 can be formed as the sleeves of the first portion 112 and the second portion 114, respectively. The first body portion 128 includes a bottom portion 148, and the distal end 142 of the second body portion 144 is attached at the bottom portion 148 to the first body portion 128. As depicted in FIG. 2, for example, the first portion 112 and the second portion 114 are attached to one another at an attachment area $A_2$, so that a portion of the distal end 142 is positioned adjacent the proximal end 124, and another portion of the distal end 142 is positioned at and adjacent the distal end 126. At least portions of the bottom portion 148 and the distal end 142 are open to one another, such that the first interior cavity portion 120 and the second interior cavity portion 122 communicate with one another through such openings to form the interior cavity 116.

Like the first body portion 28 of the first portion 12, the first body portion 128 of the first portion 112 can be form-fitting or loose with a pre-configured generally cylindrical shape that can be stretched in different directions. Like the second body portion 44 of the second portion 14, the second body portion 144 of the second portion 114 can also be form-fitting or loose. Unlike the second body portion 44 of the second portion 14, however, the second body portion 144 of the second portion 114 has a pre-configured generally frusto-conical shape that can be stretched in different directions. As depicted in FIG. 2, the proximal end 140 has a smaller size than the distal end 142, with the second body portion 144 tapering (i.e., decreasing in size) from the distal end 142 to the proximal end 140. As such, portions of the first portion 112 and/or the second portion 114 (including the first body portion 128 and/or the second body portion 144, respectively) and the sleeves formed thereby can be sized and/or be expanded/contracted in different directions to be form-fitting over portions of the gun G and/or the gun user's hand H, wrist W, and/or forearm F. Portions of first portion 112 and/or the second portion 114 (including the first body portion 128 and/or the second body portion 144, respectively) and the sleeves formed thereby can alternatively be loose fitting over portions of the gun G and/or the gun user's hand H, wrist W, and/or forearm F. Furthermore, in similar fashion to the first portion 12 and the second portion 14, the first portion 112 and/or second portion 114 can also include one or more pockets for holding one or more hand-warmers therein.

Figure 7:
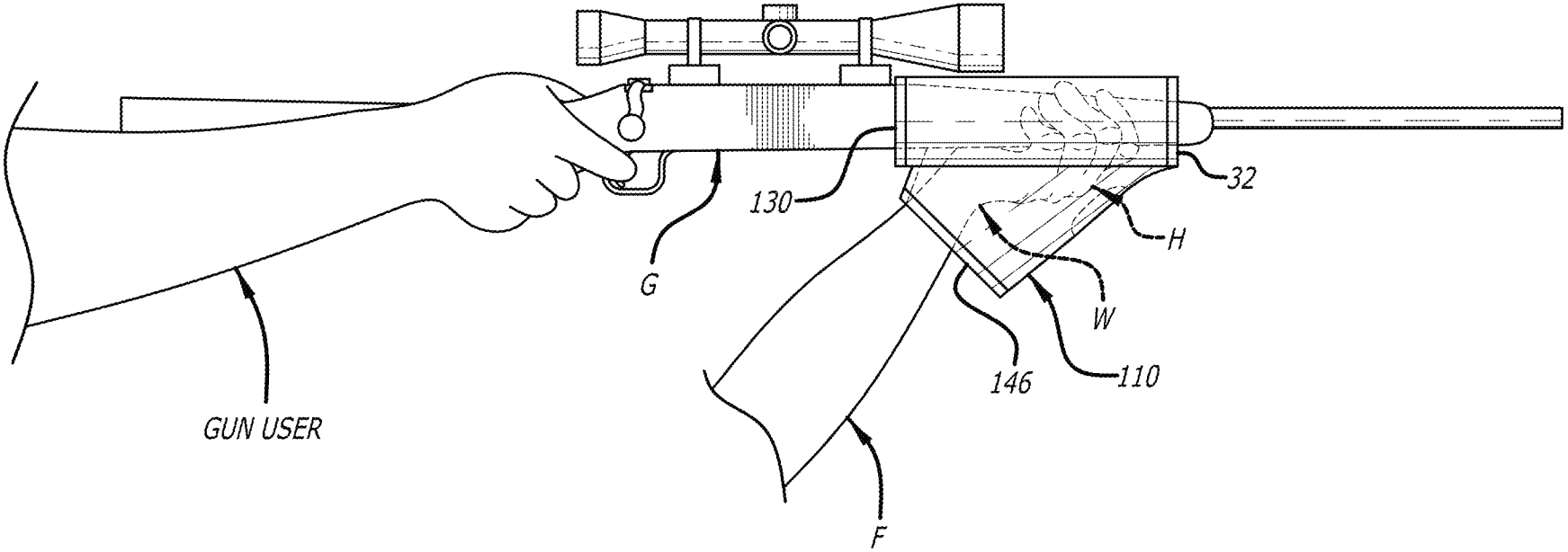
FIG. 7 is a side elevational view of the gun/hand muff of FIG. 2 positioned relative to the gun and at least the gun user's hand inserted through the gun/hand muff to grip and grasp the gun.

When using the gun/hand muff 110, portions of the gun G (including, for example, the barrel, the forend, the handguard, and/or the rail) can, as depicted in FIG. 7, be inserted through the first opening 130, through the first interior cavity portion 120, and out of the second opening 132. And other portions of the gun G (including, for example, the barrel, the forend, the handguard, and/or the rail) can, as depicted in FIG. 7, remain within the first interior cavity portion 120 after insertion through the first opening 130 and into the first interior cavity portion 120. Portions of the gun user's hand H (and possibly portions of the gun user's wrist W and forearm F) can, as depicted in FIG. 7, be inserted through the third opening 146, through the second interior cavity portion 122, and into the first interior cavity portion 120. The gun user's hand H can directly grip and grasp the portions of the gun G received in the first interior cavity portion 120. Portions of the gun G and portions of the gun user's hand H (and possibly portions of the gun user's wrist W and forearm F) can be inserted into the gun/hand muff 110 simultaneously, the portions of the gun G can be inserted first, or the portions of the gun user's hand H (and possibly portions of the gun user's wrist W and forearm F) can be inserted first. The process of insertion with respect to the gun/hand muff 110 can be completed for the portions of the gun G first, completed for portions of the gun user's hand H (and possibly portions of the gun user's wrist W and forearm F) first, or completed simultaneously.

Figure 3:
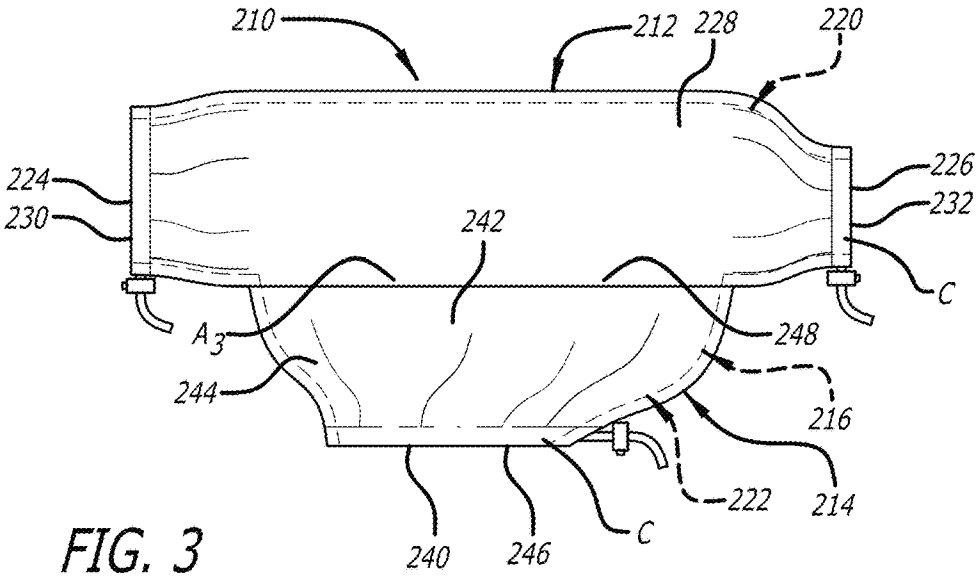
FIG. 3 is a side elevational view of a third version of the first embodiment of the protector in the form of the gun/hand muff.

The third version of the first preferred embodiment of the gun/hand muff 210 is depicted in FIG. 3, and similar numbering to that used for the gun/hand muffs 10 and 110 is also used for the gun/hand muff 210. The gun/hand muff 210 includes a first portion 212, a second portion 214, and an interior cavity 216. The first portion 212 includes a portion that can be formed as a sleeve, the second portion 214 includes a portion that can be formed as a sack, and the sleeve formed by the first portion 212 and the sack formed by the second portion 214 are attached to one another with the interior cavity 216 extending therethrough. The first portion 212 and the second portion 214 can be formed unitarily with one another, or be formed separately and then integrated with one another. As discussed below, portions of the first portion 212 and the second portion 214 can each be formed from flexible, stretchable (for example, expandable/contractible), and/or malleable materials such as, for example, fabrics. As such, the first portion 212 and the second portion 214 can have shapes that are collapsible into smaller configurations. Furthermore, portions of the first portion 212 (and the sleeve formed thereby) can be sized and/or expanded/contracted in different directions to be form-fitting or can be loose fitting around portions the gun G when these portions are inserted into the first portion 212, and portions of the second portion 214 (and the sack formed thereby) can be loose and baggy around portions of the gun user's hand H, wrist W, and forearm F when these portions are inserted into the second portion 214.

The first portion 212 includes a first interior cavity portion 220, and the second portion 214 includes a second interior cavity portion 222. The first portion 212 includes a proximal end 224, a distal end 226, a first body portion 228, a first opening 230, and a second opening 232 in similar arrangement to corresponding portions of the first portions 12 and 112 of the gun/hand muffs 10 and 110. And the second portion 214 includes a proximal end 240, a distal end 242, a second body portion 244, and a third opening 246. Portions of the first portion 212 and/or the second portion 214 adjacent the first opening 230, the second opening 232, and/or the third opening 246 can have similar configurations to those of the first portion 12 and the second portion 14 adjacent the first opening 30, the second opening 32, and the third opening 46 to facilitate expansion and contraction with or without use of the above-discussed cuffs with these openings. As depicted in FIG. 3, for example, cuffs C around the first opening 230, the second opening 232, and the third opening 246 are drawstring cuffs used to cinch against portions of the gun G and portions of the gun user's hand H, wrist W, and/or forearm F. The cuffs can have similar, larger, or smaller overall dimensions than adjacent portions of the first body portion 228 and the second body portion 244. Portions of the first body portion 228 and the second portion 244 adjacent the first opening 230, the second opening 232, and/or the third opening 246, and/or the cuffs can serve in cinching and/or sealing the gun/hand muff 210 against portions of the gun G and/or the gun user's hand H, wrist W, and/or forearm F.

The first body portion 228 and the second body portion 244 can be formed as the sleeve of the first portion 212 and the sack of the second portion 214, respectively. The first body portion 228 includes a bottom portion 248, and the distal end 242 of the second body portion 244 is attached at the bottom portion 248 to the first body portion 228. As depicted in FIG. 3, for example, the first portion 212 and the second portion 214 are attached to one another at an attachment area As, so that a portion of the distal end 242 is positioned adjacent the proximal end 224, and another portion of the distal end 242 is positioned at and adjacent the distal end 226. At least portions of the bottom portion 248 and the distal end 242 are open to one another, such that the first interior cavity portion 220 and the second interior cavity portion 222 communicate with one another through such openings to form the interior cavity.

Like the first body portion 28 of the first body portion 12 and the first body portion 128 of the first body portion 112, the first body portion 228 of the first portion 212 can be form-fitting or loose with a pre-configured generally cylindrical shape. And unlike the second body portion 44 of the second portion 14, but like the second body portion 144 of the second portion 114, the second body portion 244 of the second portion 214 has a pre-configured generally frusto-conical shape. As depicted in FIG. 2, the proximal end 240 has a smaller size than the distal end 242, with the second body portion 244 tapering (i.e., decreasing in size) from the distal end 244 to the proximal end 240. Portions of the second body portion 244 are not form-fitting, but instead are loose and baggy, and can include pleatings that afford expansion and contraction thereof. Portions of the first portion 212 (including the first body portion 228) and the sleeve formed thereby can alternatively be loose fitting over portions of the gun G. Furthermore, in similar fashion to the first portion 12 and the second portion 14, the first portion 212 and/or second portion 214 can also include one or more pockets for holding one or more hand-warmers therein.

Figure 8:
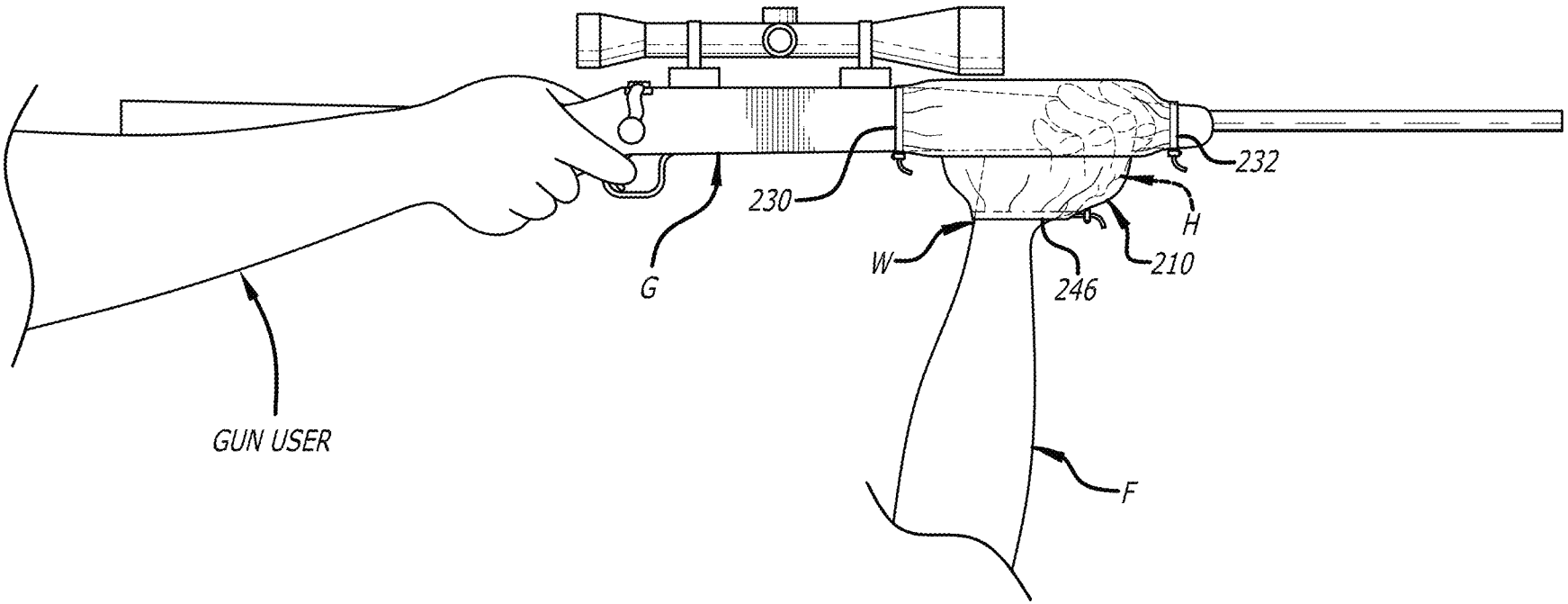
FIG. 8 is a side elevational view of the gun/hand muff of FIG. 3 positioned relative to the gun and at least the gun user's hand inserted through the gun/hand muff to grip and grasp the gun.

When using the gun/hand muff 210, portions of the gun G (including, for example, the barrel, the forend, the handguard, and/or the rail) can, as depicted in FIG. 8, be inserted through the first opening 230, through the first interior cavity portion 220, and out of the second opening 232. And other portions of the gun G (including, for example, the barrel, the forend, the handguard, and/or the rail) can, as depicted in FIG. 8, remain within the first interior cavity portion 220 after insertion through the first opening 230 and into the first interior cavity portion 220. Portions of the gun user's hand H (and possibly portions of the gun user's wrist W and forearm F) can, as depicted in FIG. 8, be inserted through the third opening 246, through the second interior cavity portion 222, and into the first interior cavity portion 220. The gun user's hand H can directly grip and grasp the portions of the gun G received in the first interior cavity portion 220. Portions of the gun G and portions of the gun user's hand H (and possibly portions of the gun user's wrist W and forearm F) can be inserted into the gun/hand muff 210 simultaneously, the portions of the gun G can be inserted first, or the portions of the gun user's hand H (and possibly portions of the gun user's wrist W and forearm F) can be inserted first. The process of insertion with respect to the gun/hand muff 210 can be completed for the portions of the gun G first, completed for portions of the gun user's hand H (and possibly portions of the gun user's wrist W and forearm F) first, or completed simultaneously.

Figure 4:
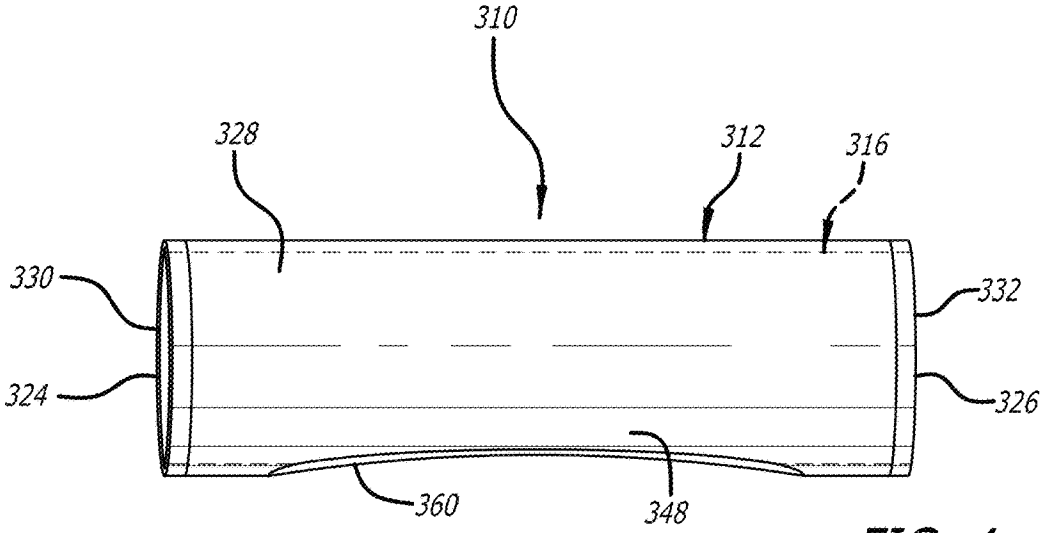
FIG. 4 is a side perspective view of fourth version of the first embodiment of the protector in the form of the gun/hand muff.

The fourth version of the first preferred embodiment of the gun/hand muff 310 is depicted in FIG. 4, and similar numbering to that used for the gun/hand muffs 10, 110, and 210 is also used for the gun/hand muff 310. The gun/hand muff 310 includes a first portion 312 and an interior cavity 316.. The first portion can be formed as a single sleeve with the interior cavity 316 extending therethrough. As discussed below, portions of the first portion 312 can each be formed from flexible, stretchable (for example, expandable/contractible), and/or malleable materials such as, for example, fabrics. As such, the first portion 312 can have a shape that is collapsible into smaller configurations. Furthermore, portions of the first portion 312 (and the sleeve formed thereby) can be sized and/or expanded/contracted in different directions to be form-fitting or can be loose fitting around portions of the gun G and portions of the gun user's hand H, wrist W, and/or forearm F, when these portions are inserted into the first portion 312.

The first portion 312 includes a proximal end 324, a distal end 326, a first body portion 328, a first opening 330, and a second opening 332 in similar arrangement to corresponding portions of the first portions 12, 112, 212 of the gun/hand muffs 10, 110, and 210. Portions of the first portion 312 adjacent the first opening 330 and/or the second opening 332 can have similar configurations to those of the first portion 12 adjacent the first opening 30 and the second opening 32 to facilitate expansion and contraction with or without use of the above-discussed cuffs with these openings. The cuffs can have similar, larger, or smaller overall dimensions than adjacent portions of the first body portion 328. Portions of the first body portion 328 adjacent the first opening 330 and the second opening 332, and/or the cuffs can serve in cinching and/or sealing the gun/hand muff 310 against portions of the gun G and/or the gun user's hand H, wrist W, and/or forearm F The first body portion 328 can be formed as the sleeve of the first portion 312. Like the first body portion 28 of the first portion 12, the first body portion 128 of the first portion 112 can be form-fitting or loose with a pre-configured generally cylindrical shape. The first body portion 328 includes a bottom portion 348 with an opening 360 through a portion of the bottom portion 348. The opening 360 provides access to the interior cavity 316, and can have similar a configuration to that of the third opening 46. As such, portions of the first body portion 328 adjacent the opening 360 and/or the cuff can serve in cinching and/or sealing the gun/hand muff against portions the gun user's hand H, wrist W, and/or forearm F Portions of the first portion 312 (including the first body portion 328) and the sleeve formed thereby can be sized and/or be expanded/contracted in different directions to be form-fitting over portions of the gun G and the gun user's hand H, wrist W, and/or forearm F that are inserted into the interior cavity 316. Portions of first portion 312 (including the first body portion 328) and the sleeve formed thereby can alternatively be loose fitting over portions of the gun G and/or the gun user's hand H, wrist W, and/or forearm F that are inserted into the interior cavity 316. Furthermore, while FIG. 4 shows that only a portion of the gun user's hand H is received in the interior cavity 316 via the opening 360, the first portion 312 can have a greater size to accommodate more of the gun user's hand H and possibly portions of the gun user's wrist W and forearm F. Furthermore, in similar fashion to the first portion 12 and the second portion 14, the first portion 312 can also include one or more pockets for holding one or more hand-warmers therein.

Figure 9:
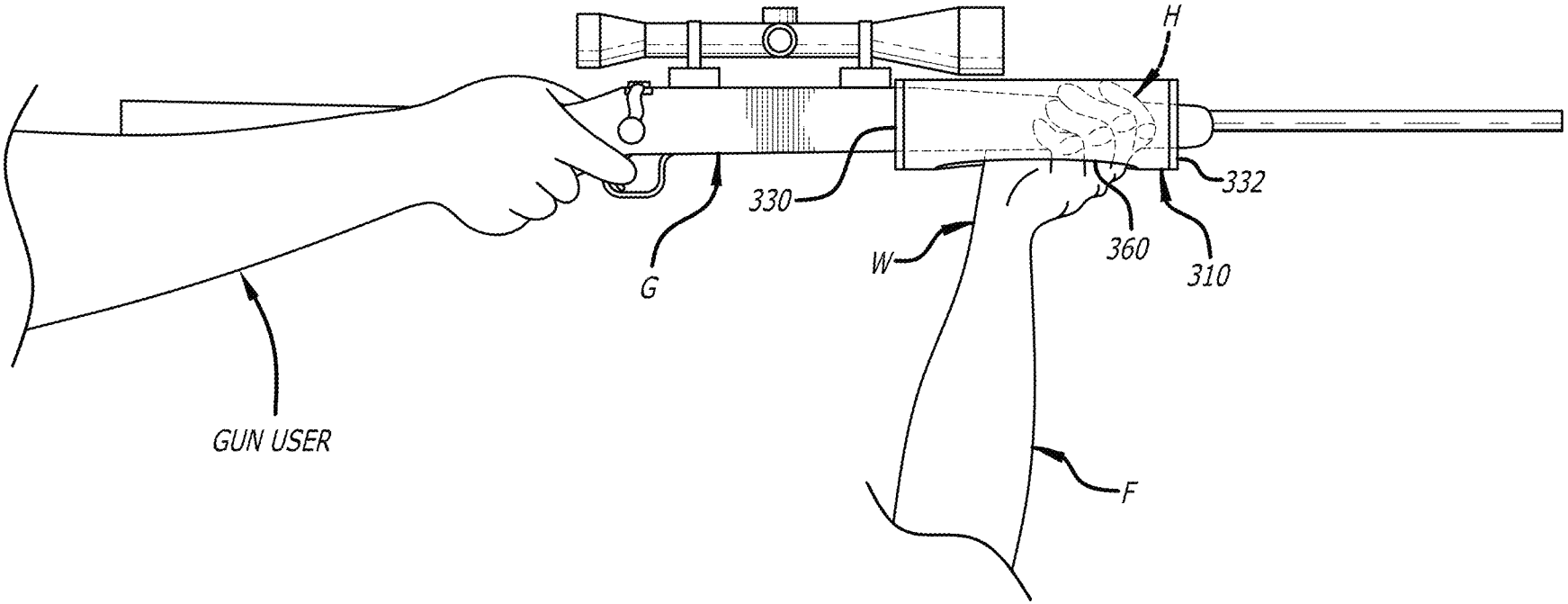
FIG. 9 is a side elevational view of the gun/hand muff of FIG. 4 positioned relative to the gun and at least the gun user's hand inserted through the gun/hand muff to grip and grasp the gun.

When using the gun/hand muff 310, portions of the gun G (including, for example, the barrel, the forend, the handguard, and/or the rail) can, as depicted in FIG. 9, be inserted through the first opening 330, through the interior cavity 316, and out of the second opening 332. And other portions of the gun G (including, for example, the barrel, the forend, the handguard, and/or the rail) can, as depicted in FIG. 9, remain within the interior cavity 316 after insertion through the first opening 330 and into the interior cavity 316. Portions of the gun user's hand H (and possibly portions of the gun user's wrist W and forearm F) can, as depicted in FIG. 9, be inserted through the opening 360 and into the interior cavity 316. The gun user's hand H can directly grip and grasp the portions of the gun G received in the interior cavity 316. Portions of the gun G and portions of the gun user's hand H (and possibly portions of the gun user's wrist W and forearm F) can be inserted into the gun/hand muff 310 simultaneously, the portions of the gun G can be inserted first, or the portions of the gun user's hand H (and possibly portions of the gun user's wrist W and forearm F) can be inserted first. The process of insertion with respect to the gun/hand muff 310 can be completed for the portions of the gun G first, completed for portions of the gun user's hand H (and possibly portions of the gun user's wrist W and forearm F) first, or completed simultaneously.

Figure 5:
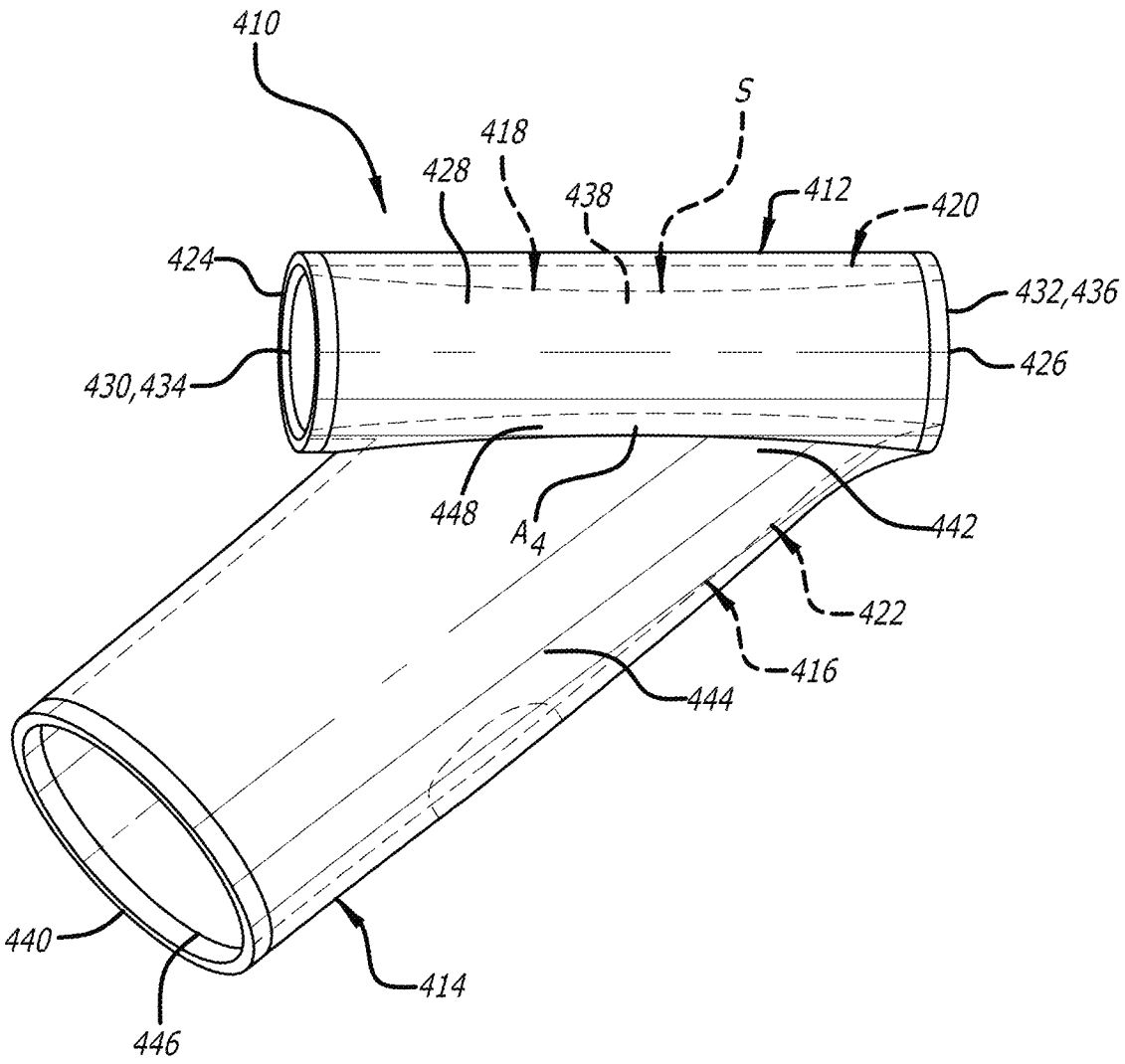
FIG. 5 is a side perspective view of a second embodiment of a protector in the form of the gun/hand muff including a sheath.

FIG. 5 depicts a version of the second preferred embodiment of the gun/hand muff generally indicated by the numeral 410. Although the gun/hand muff 410 is similar to the gun/hand muff 10, the gun/hand muff 410 can alternatively include features of the gun/hand muffs 110, 210, and 310. Similar number to that used for the gun/hand muff 10 is also used for the gun/hand muff 410. As discussed below, the gun/hand muff 410 includes a sheath S in which a portions of the gun G can be received, and the gun user can grip and grasp the gun G indirectly by contacting the sheath S. The sheath S can provide heat protection from portions of the gun G, or insulate the gun user's hand from a cold portion of the gun G, and can also be used with the gun/hand muffs 110, 210, and 310.

In addition to the sheath S, the second preferred embodiment of the gun/hand muff 410 includes a first portion 412, a second portion 414, and an interior cavity 416. The sheath S, the first portion 412, and the second portion 414 can each include portions that can be formed as a sleeve, and these sleeves are attached to one another with the interior cavity 416 extending through at least portions of the first portion 412 and the second portion 414. The sheath S, the first portion 412, and/or the second portion 414 can be formed unitarily with one another, or be formed separately and then integrated with one another. As discussed below, the sheath S, the first portion 412, and the second portion 414 can each be formed from flexible, stretchable (for example, expandable/contractible), and/or malleable materials. As such, the sheath S, the first portion 412, and the second portion 414 can have shapes that are collapsible into smaller configurations. Furthermore, portions of the sheath S, the first portion 412 and the second portion 414 (and the sleeves formed thereby) can be sized and/or expanded/contracted in different directions to be form-fitting or can be loose fitting around portions of the gun G and portions of the gun user's hand H, wrist W, and/or forearm F, when portions of the gun G are inserted through the sheath S and the first portion 412, and portions of the gun user's hand H, wrist W, and/or forearm F are inserted through the second portion 414.

The sheath S can include an interior cavity 418, the first portion 412 can include a first interior cavity portion 420, and the second portion 14 can include a second interior cavity portion 422. The interior cavity portions 420 and 422 can communicate with one another and form portions of the interior cavity 416. The first portion 412 includes a proximal end 424, a distal end 426, a first body portion 428, a first opening 430, and a second opening 432 in similar arrangement to corresponding portions of the first portion 12 of the gun/hand muff 10. Furthermore, the sheath S includes a proximal opening 434, a distal opening 436, and a sheath body portion 438. And the second portion 414 includes a proximal end 440, a distal end 442, a second body portion 444, and a third opening 446 in similar arrangement to corresponding portions of the second portion 14 of the gun/hand muff 10.

The first body portion 428, the sheath body portion 438, and the second body portion 444 can be formed as the sleeves of the first portion 412, the sheath S, and the second portion 414, respectively. The first body portion 428 can include a bottom portion 448, and the distal end 442 of the second body portion 444 is attached at the bottom portion 448 of the first body portion 428. As depicted in FIG. 4, for example, the first portion 412 and the second portion 414 are attached to one another, so that a portion of the distal end 442 is positioned adjacent the proximal end 424, and another portion of the distal end 442 is positioned at and adjacent the distal end 426. At least portions of the bottom portion 448 and the distal end 442 are open to one another at an attachment area $A_4$, such that the first interior cavity portion 420 and the second interior cavity portion 422 communicate with one another through such openings to form the interior cavity 416. Like the first body portion 28 of the first portion 12 and the second body portion 44 of the second portion 14, the first body portion 428 of the first portion 412 can alternatively be form-fitting or loose with a pre-configured generally cylindrical shape, and the second body portion 444 of the second portion 414 can alternatively be form-fitting or loose with a pre-configured generally cylindrical shape. However, the first body portion 428 of the first portion 412, and the second body portion 444 of the second portion 414 are not so limited with respect to shape and configuration. The first body portion 428 and the second body portion 444 can instead include the above-discussed shapes and configurations detailed with respect to the gun/hand muffs 10, 110, 210, and 310. Also, in similar fashion, the sheath S can also alternatively be form-fitting or loose with a pre-configured generally cylindrical shape. However, the shape and configuration of the sheath S is not so limited, and include various shapes and configuration similar to those of the first portions 12, 112, 212, and 312 and the second portions 14, 114, 214, and 314 of the gun/hand muffs 10, 110, 210, and 310, respectively. Furthermore, in similar fashion to the first portion 12 and the second portion 14, the first portion 412 and/or second portion 414 can also include one or more pockets for holding one or more hand-warmers therein.

The sheath S can extend between the first opening 430 and the second opening 432 of the first portion 412. As depicted in FIG. 5, the proximal opening 434 is attached around the first opening 430, and the distal opening 436 is attached around the second opening 432, so that the interior cavity 418 of the sheath effectively extends between the first opening 430 and the second opening 432. Portions of the first portion 412 and/or the sheath S adjacent the first opening 430, the second opening 432, the third opening 446, the proximal opening 434, and/or the distal opening 436 can include features of the first portion 12 and the second portion 14 adjacent the first opening 30, the second opening 32, and the third opening 46 to facilitate expansion and contraction thereof with or without use of the above-discussed cuffs with these openings. The cuffs can have similar, larger, or smaller overall dimensions than adjacent portions of the first body portion 428 and the second body portion 444. Portions of the first body portion 428 and the second portion 444 adjacent the first opening 430, the second opening 432, and/or the third opening 446, and/or the cuffs can serve in cinching and/or sealing the gun/hand muff 410 against portions of the gun G and/or the gun user's hand H, wrist W, and/or forearm F.

The sheath S can also include holes (not shown) in the sheath body portion 438. The holes in the sheath body portion 438 could afford insertion of fingertips of the gun user's hand H therethrough to contact portions of the gun G inserted into the interior cavity 418. Thus, while gripping and grasping the gun G, the gun user's fingertips can be inserted through the holes in the sheath body portion 438 to directly contact portions of the gun G inserted into the interior cavity 418, and the remainder of the gun user's hand can indirectly contact portions of the gun G through the sheath body portion 438 of the sheath S.

When using the gun/hand muff 410, portions of the gun G (including, for example, the barrel, the forend, the handguard, and/or the rail) can, as depicted in FIG. 10, be inserted through the proximal opening 434, through the interior cavity 418, and out of the distal opening 436. And other portions of the gun G (including, for example, the barrel, the forend, the handguard, and/or the rail) can, as depicted in FIG. 10, remain within the interior cavity 418 after insertion through the proximal opening 434 and into the interior cavity 418. Portions of the gun user's hand H (and possibly portions of the gun user's wrist W and forearm F) can, as depicted in FIG. 10, be inserted through the third opening 446, through the first interior cavity portion 420, and into the second interior cavity portion 422. When the portions of the gun G are received in the interior cavity 418, and portions of the gun user's hand H, wrist W, and/or forearm F are received in the interior cavity 416 (after insertion through the third opening 446), the gun user's hand H can grasp and grip portions of the gun G indirectly by grasping and gripping the portions of the gun G through the sheath body portion 438 of the sheath S. If the holes in the sheath body portion 438 are provided, the gun user's fingertips can directly contact the portions of the gun G inserted into the interior cavity 418. Portions of the gun G and portions of the gun user's hand H (and possibly portions of the gun user's wrist W and forearm F) can be inserted into the gun/hand muff 410 simultaneously, the portions of the gun G can be inserted first, or the portions of the gun user's H (and possibly portions of the gun user's wrist W and forearm F) can be inserted first. The process of insertion with respect to the gun/hand muff 410 can be completed for the portions of the gun G first, completed for portions of the gun user's hand H (and possibly portions of the gun user's wrist W and forearm F) first, or completed simultaneously.

As discussed above, portions of the first portions 12, 112, 212, 312, 412, portions of the second portions 14, 114, 214, 414, and portions of the sheath S can be made of flexible, stretchable, and/or malleable materials. The materials can include fabrics that are woven, non-woven, textile, and/or non-textile. The materials can also include organic and/or non-organic films, membranes, or sheets. And these materials can be used as a singular layer or be combined with one another in multiple layers to form portions of the first portions 12, 112, 212, 312, 412, portions of the second portions 14, 114, 214, 414, and portions of the sheath S. Furthermore, portions of the gun/hand muffs 10, 110, 210, 310, and 410 as discussed above, can have preconfigured shapes that retain their shape or are deformable (such as being form-fitting or loose) during use, and these properties can be afforded by the materials selected for portions of the first portions 12, 112, 212, 312, 412, portions of the second portions 14, 114, 214, 414, and portions of the sheath S.

The selection of the materials for portions of the gun/hand muffs 10, 110, 210, 310, and 410 can also be based, for example, on waterproof/repellant properties, breathability properties, moisture-wicking properties, and/or insulative properties. Thus, depending on the materials selected for portions of the gun/hand muffs 10, 110, 210, 310, and 410, the singular or multiple layers of these materials can provide the desired properties. Furthermore, different portions and different layers of the gun/hand muffs 10, 110, 210, 310, and 410 can be constructed of materials having these different properties. For example, one layer used for the portions of the first portions 12, 112, 212, 312, 412, portions of the second portions 14, 114, 214, and 414. and portions of the sheath S can be waterproof/repellant, another layer can be breathable, yet another layer can be moisture-wicking, and/or yet still another layer can be insulative.

As depicted in FIGS. 1-3 and 5, except for the first openings 30, 130, 230, and 430, the second openings 32, 132, 232, and 432, and being attached to and opened into the second portions 14, 114, 214, and 414, respectively, the first portions 12, 112, 212, and 412 can be configured to include no other apertures, holes, and/or perforations through the body portions 28, 128, 228, and 428. Likewise, except for the first opening 330, the second opening 332, and the opening 360, the first portion 312 can be configured to include no other apertures, holes, perforations through the body portion 328. However, the first body portions 28, 128, 228, 338, and 428 can include other apertures, holes, and/or perforations that, for example, afford heat to be expelled from the first interior cavity portions 20, 120, 220, and 420 and the interior cavity 316. Similarly, such heat-expelling apertures, holes, and/or perforations can also be included in the second body portions 44, 144, 244, and 444 of the second portions 14, 114, 214, and 414. These heating-expelling apertures, holes, and/or perforations can include flaps or can be positioned on the first portions 12, 112, 212, 312, and 412 and the second body portions 44, 144, 244, and 444 to inhibit the elements from entering into the gun/hand muffs 10, 110, 210, 310, and 410.

Also, the first body portions 12, 113, 212, 312, and 412 could be split or separated along all or portions of the lengths thereof between the first openings 30, 130, 230, 330, and 430 and the second openings 32, 132, 232, 332, and 432 to provide additional access to the first interior cavity portions 20, 120, 220, and 420 and the interior cavity 316. These splits or separations could be closed using button, snap button, Velcro®, and/or zipper enclosures.

If split or separated along all of the lengths thereof, the first body portions 12, 113, 212, 312, and 412 could be laid entirely open, and portions of the gun could then be positioned adjacent the laid-open first body portions 12, 113, 212, 312, and 412, and the button, snap button, Velcro®, and/or zipper enclosures could then be engaged to wrap and close the first body portions 12, 113, 212, 312, and 412 around the portions of the gun. Furthermore, if split or separated along portions of the lengths thereof, the first body portions 12, 113, 212, 312, and 412 could be laid partially open to facilitate insertion of portions of the gun into the first interior cavity portions 20, 120, 220, and 420 and the interior cavity 316, and the button, snap button, Velcro®, and/or zipper enclosures could then be engaged to close the first body portions 12, 113, 212, 312, and 412 around the portions of the gun. After such engagement, the portions of the gun would be received with the first interior cavity portions 20, 120, 220, and 420 and the interior cavity 316. The second body portions 44, 144, 244, and 444 could also be split or separated along portions of the length thereof, and include button, snap button, Velcro®, and/or zipper enclosures to facilitate receipt of the gun user's hand H, wrist W, and/or forearm F within the second interior cavity portions 22, 122, 222, and 422.

Additionally, rather than the gun/hand muffs 10, 110, 210, 310, and 410 being separate articles, the gun/hand muffs 10, 110, 210, 310, and 410 could be attached and/or integrated with articles of clothing such as long-sleeve shirts, jackets, and coats. To illustrate, distal ends of sleeves of the long-sleeve shirts, jackets, and coats could be attached to the proximal ends 46, 146, 246, and 446 of the gun/hand muffs 10, 110, 210, and 410, respectively, and attached to the bottom portion 348 of the gun/hand muff 310. Thus, when inserting the gun user's hand H, wrist W, and forearm F through a sleeve of the long-sleeve shirt, jacket, and coat, the user's hand H and possibly portions of the gun user's wrist W and forearm F can be inserted through the third openings 46, 146, 246, and 446 and the opening 360, and the gun/hand muffs 10, 110, 210, 310, and 410 can then be used as described above.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (for example, all described acts or events may not be necessary to carry out the techniques). In addition, while certain aspects of this disclosure are described as being performed by a single module or unit for purposes of clarity, it should be understood that the techniques of this disclosure may be performed by a combination of units or modules.

We claim:

1. A protector for at least portions of a hand of a user when holding a gun, the protector comprising:

an exterior portion including a proximal first end, an opposite distal second end, a first exterior-portion opening positioned at a location between the proximal first end and the distal second end of the exterior portion, a second exterior-portion opening at the proximal first end of the exterior portion, a third exterior-portion opening at the distal second end of the exterior portion, and a first interior area provided inside the exterior portion between the first exterior-portion opening, the second exterior-portion opening, and the third exterior-portion opening;

an interior-sheath portion extending through at least a portion of the exterior portion, and including a proximal first end, an opposite distal second end, a first sheath inlet at the proximal first end of the interior-sheath, a second sheath inlet at the distal second end of the interior-sheath, and a second interior area definable inside the interior-sheath portion between the first sheath inlet and the second sheath inlet;

wherein an interior cavity is provided within the exterior portion, and the interior cavity is defined by portions of the exterior portion inside the first interior area, and by portions of the interior-sheath portion outside of the second interior area;

wherein a first portion of the gun can be inserted through the second exterior-portion opening, through the first sheath inlet, through the second interior area, through the second sheath inlet, and out of the third exterior-portion opening, and a second portion of the gun can be inserted through the second exterior-portion opening, through the first sheath inlet, and into the second interior area to remain therein; and wherein the hand of the user can be inserted through the first exterior-portion opening into the interior cavity, and the second portion of the gun remaining in the second interior area can be gripped and grasped by the hand of the user via contact with the interior-sheath portion.

2. The protector of claim 1, wherein the interior-sheath portion extends from at or adjacent the first proximal end of the exterior portion to at or adjacent the second distal end of the exterior portion within the interior cavity.

3. The protector of claim 2, wherein the first sheath inlet of the interior-sheath portion is positioned at or adjacent the first exterior-portion opening, and the second sheath inlet of the interior-sheath portion is positioned at or adjacent the second exterior-portion opening.

4. The protector of claim 3, wherein, after receipt of the second portion of the gun in the second interior area, at least a portion of the interior-sheath portion forms a complete perimeter around the second portion of the gun.

5. The protector of claim 1, wherein the first sheath inlet of the interior-sheath portion is positioned at or adjacent the first exterior-portion opening, and the second sheath inlet of the interior-sheath portion is positioned at or adjacent the second exterior-portion opening.

6. The protector of claim 5, wherein, after receipt of the second portion of the gun in the second interior area, at least a portion of the interior-sheath portion forms a complete perimeter around the second portion of the gun.

7. The protector of claim 1, wherein the exterior portion includes an expandable and contractable first cuff formed around the first exterior-portion opening, and an expandable and contractable second cuff formed around the second exterior-portion opening.

8. The protector of claim 1, wherein the exterior portion is expandable and contractable at and adjacent the proximal first end of the exterior portion, and the exterior portion is expandable and contractable at and adjacent the distal second end of the exterior portion.

9. The protector of claim 1, wherein the exterior portion forms a complete perimeter around the first exterior-portion opening, the exterior portion forms a complete perimeter around the second exterior-portion opening, and the exterior portion forms a complete perimeter around the third exterior-portion opening.

10. A protector for at least portions of a hand of a user when holding a gun, the protector comprising:

an exterior portion including a proximal first end, an opposite distal second end, a first exterior-portion opening positioned at a location between the proximal first end and the distal second end of the exterior portion, a second exterior-portion opening at the proximal first end of the exterior portion, a third exterior-portion opening at the distal second end of the exterior portion, and a first interior area provided inside the exterior portion between the first exterior-portion opening, the second exterior-portion opening, and the third exterior-portion opening, the exterior portion forming a complete perimeter around the second exterior-portion opening, and the exterior portion forming a complete perimeter around the third exterior-portion opening;

an interior-sheath portion extending through at least a portion of the first interior area of the exterior portion from adjacent the first proximal end of the exterior portion to adjacent the second distal end of the exterior portion, and including a proximal first end, an opposite distal second end, a first sheath inlet definable at the proximal first end of the interior-sheath, a second sheath inlet definable at the distal second end of the interior-sheath, and a second interior area definable inside the interior-sheath portion between the first sheath inlet and the second sheath inlet;

wherein an interior cavity is provided within the exterior portion, and the interior cavity is defined by portions of the exterior portion inside the first interior area, and by portions of the interior-sheath portion outside of the second interior area;

wherein a first portion of the gun can be inserted through the second exterior-portion opening, through the first sheath inlet, through the second interior area, through the second sheath inlet, and out of the third exterior-portion opening, and a second portion of the gun can be inserted through the second exterior-portion opening, through the first sheath inlet, and into the second interior area to remain therein; and wherein the hand of the user can be inserted through the first exterior-portion opening into the interior cavity, and the second portion of the gun remaining in the second interior area can be gripped and grasped by the hand of the user via contact with the interior-sheath portion.

11. The protector of claim 10, wherein the first sheath inlet of the interior-sheath portion is positioned adjacent the first exterior-portion opening, and the second sheath inlet of the interior-sheath portion is positioned adjacent the second exterior-portion opening.

12. The protector of claim 11, wherein, after receipt of the second portion of the gun in the second interior area, at least a portion of the interior-sheath portion forms a complete perimeter around the second portion of the gun.

13. The protector of claim 10, wherein, after receipt of the second portion of the gun in the second interior area, at least a portion of the interior-sheath portion forms a complete perimeter around the second portion of the gun.

14. The protector of claim 10, wherein the exterior portion includes an expandable and contractable first cuff formed around the first exterior-portion opening, and an expandable and contractable second cuff formed around the second exterior-portion opening.

15. The protector of claim 10, wherein the exterior portion is expandable and contractable at and adjacent the proximal first end of the exterior portion, and the exterior portion is expandable and contractable at and adjacent the distal second end of the exterior portion.

16. The protector of claim 10, wherein the exterior portion forms a complete perimeter around the first exterior-portion opening.

17. A protector for at least portions of a hand of a user when holding a gun, the protector comprising:

an exterior portion including a proximal first end, an opposite distal second end, a first exterior-portion opening positioned at a location between the proximal first end and the distal second end of the exterior portion, a second exterior-portion opening at the proximal first end of the exterior portion, a third exterior-portion opening at the distal second end of the exterior portion, and a first interior area provided inside the exterior portion between the first exterior-portion opening, the second exterior-portion opening, and the third exterior-portion opening, the exterior portion forming a complete perimeter around the second exterior-portion opening, and the exterior portion forming a complete perimeter around the third exterior-portion opening;

an interior-sheath portion extending through at least a portion of the first interior area of the exterior portion between the first proximal end of the exterior portion and the second distal end of the exterior portion, and including a proximal first end, an opposite distal second end, a first sheath inlet at the proximal first end of the interior-sheath, a second sheath inlet at the distal second end of the interior-sheath, and a second interior area definable inside the interior-sheath portion between the first sheath inlet and the second sheath inlet;

wherein the first sheath inlet of the interior-sheath portion is positioned adjacent the first exterior-portion opening, and the second sheath inlet of the interior-sheath portion is positioned adjacent the second exterior-portion opening;

wherein an interior cavity is provided within the exterior portion, and the interior cavity is defined by portions of the exterior portion inside the first interior area, and by portions of the interior-sheath portion outside of the second interior area;

wherein a first portion of the gun can be inserted through the second exterior-portion opening, through the first sheath inlet, through the second interior area, through the second sheath inlet, and out of the third exterior-portion inlet, and a second portion of the gun can be inserted through the second exterior-portion opening, through the first sheath inlet, and into the second interior area to remain therein; and wherein the hand of the user can be inserted through the first exterior-portion opening into the interior cavity, and the second portion of the gun remaining in the second interior area can be gripped and grasped by the hand of the user via contact with the interior-sheath portion.

18. The protector of claim 17, wherein, after receipt of the second portion of the gun in the second interior area, at least a portion of the interior-sheath portion forms a complete perimeter around the second portion of the gun.

19. The protector of claim 17, wherein the exterior portion is expandable and contractable at and adjacent the proximal first end of the exterior portion, and the exterior portion is expandable and contractable at and adjacent the distal second end of the exterior portion.

20. The protector of claim 17, wherein the exterior portion forms a complete perimeter around the first exterior-portion opening.

* * * * *